US006158580A

United States Patent [19]

Davis

[11] Patent Number: 6,158,580

[45] Date of Patent: Dec. 12, 2000

[54] CONTAINER HAVING A HUMIDITY CONTROL SYSTEM

[75] Inventor: Kenneth C Davis, Columbia, S.C.

[73] Assignee: Kenneth Davis, Columbia, S.C.

[21] Appl. No.: 09/385,122

[22] Filed: Aug. 27, 1999

[51] Int. Cl.[7] ..... B65D 81/26

[52] U.S. Cl. ..... 206/204; 206/0.81; 206/223; 206/449; 220/367.1

[58] Field of Search ..... 206/204, 0.8, 0.81–0.84, 206/223, 449; 220/202, 212, 367.1, 521, 522, 256, 796; 426/106; 224/578, 901.4

[56] References Cited

U.S. PATENT DOCUMENTS

| | | | |
|---|---|---|---|
| 2,690,946 | 10/1954 | Roehrl | 206/204 |
| 2,853,223 | 9/1958 | Paflas . | |
| 3,077,409 | 2/1963 | Baselt . | |
| 3,163,189 | 12/1964 | Fitzsimmons . | |
| 3,199,750 | 8/1965 | Livingstone . | |
| 3,253,751 | 5/1966 | Paton . | |
| 3,262,478 | 7/1966 | Amsterdam | 206/0.81 |
| 3,424,351 | 1/1969 | Cilluffo et al. . | |
| 3,719,025 | 3/1973 | Heinze et al. . | |
| 3,789,616 | 2/1974 | Davidge . | |
| 4,023,602 | 5/1977 | Sparr . | |
| 4,221,291 | 9/1980 | Hunt . | |
| 4,246,007 | 1/1981 | Hunt . | |
| 4,248,543 | 2/1981 | Carrington et al. . | |
| 4,279,350 | 7/1981 | King | 206/204 |
| 4,489,859 | 12/1984 | Hofe . | |
| 4,509,653 | 4/1985 | Corbett . | |
| 4,653,661 | 3/1987 | Buchner et al. . | |
| 4,667,814 | 5/1987 | Wakamatsu et al. | 206/204 |
| 4,685,273 | 8/1987 | Caner et al. . | |
| 4,834,234 | 5/1989 | Sacherer et al. | 206/204 |
| 4,966,780 | 10/1990 | Hargraves et al. . | |
| 5,096,724 | 3/1992 | Zenner et al. . | |
| 5,148,613 | 9/1992 | Cullen | 206/204 |
| 5,176,297 | 1/1993 | Mooney et al. . | |
| 5,242,696 | 9/1993 | McDevitt . | |
| 5,254,354 | 10/1993 | Stewart . | |
| 5,395,002 | 3/1995 | Adler . | |
| 5,542,583 | 8/1996 | Boyer et al. . | |
| 5,669,528 | 9/1997 | Romero et al. . | |
| 5,766,660 | 6/1998 | Lee et al. | 206/204 |
| 5,806,710 | 9/1998 | Shiffer . | |
| 5,813,564 | 9/1998 | Luo | 206/204 |
| 5,816,024 | 10/1998 | Sanfilippo et al. . | |
| 5,843,501 | 12/1998 | Rubin et al. . | |
| 5,871,120 | 2/1999 | Romero et al. . | |
| 5,934,458 | 8/1999 | Duron | 206/204 |

*Primary Examiner*—Luan K. Bui
*Attorney, Agent, or Firm*—Michael E. Wever; Michael A. Mann; Nexsen Pruet Jacobs & Pollard

[57] ABSTRACT

A container for holding various articles and which contains a moisture control system for reducing humidity within the container. The moisture control system prevents moisture from penetrating in the interior of the container and reduces humidity that enters the interior when the lid of the container has been opened. The moisture control system comprises a moisture cup that is received within an opening in the container, a desiccant holder that is carried by the cup, a mesh screen that is dimensioned to receive a desiccant and a top. The moisture cup performs three functions: (1) it prevents moisture from penetrating the interior of the container through the opening; (2) it directs moisture from within the interior of the container to the desiccant; and (3) it holds the desiccant. In order to more conveniently transport the detergent, a strap is attached on each side of the container.

20 Claims, 5 Drawing Sheets

CONTAINER HAVING A HUMIDITY CONTROL SYSTEM

FIELD OF THE INVENTION

The present invention relates to containers designed to keep their contents dry. In particular, the present invention is a container having a humidity reduction control system that is especially suitable for granular materials.

BACKGROUND

Granular materials, if they absorb moisture from the air, may tend to form clumps or to "cake" and no longer flow well. Some granular materials suffer more from moisture absorption than others, particularly materials that dissolve in water such as chemical fertilizers and detergents. These are best kept in air tight containers and in low-humidity environments.

Detergents are often kept in laundries, under sinks, in garages, in the trunks of vehicles and outside on back porches; these are clearly not low-humidity environments. Furthermore, their containers are usually made of cardboard perhaps coated with a moisture proof coating of plastic. However, once opened, the granules of detergent will absorb moisture from the air until the detergent cakes. Unusable in this form, the now-hardened detergent must be manually broken-apart into small granules to function as originally designed. There is a need for a container that will prevent or at least limit moisture absorption by such materials.

Doing the laundry in a home or apartment is always a chore but doing laundry at a laundry room or self-service laundry is even more so. In a home, all of the supplies needed for doing the laundry are often kept in one place such as a laundry room. When doing laundry in a self-service laundry, these supplies must be taken along. In addition to the dirty clothes that have to be taken to the self-service laundry, all of the laundry supplies such as detergent, softener and bleach are required. Additionally, there is a need for coins or debit cards to operate the machines.

There is a need for a suitable way to transport these items in a organized manner so that nothing is forgotten or lost in the process.

SUMMARY OF THE INVENTION

According to its major aspects and broadly stated, the present invention is a container for holding various articles and which contains a moisture management system for reducing humidity within the container. The moisture management system prevents moisture from penetrating into the interior of the container, reduces humidity that has entered the interior when the lid of the container has been opened and traps moisture from the stored contents such that it may be removed. The moisture management system comprises a moisture cup that is received within an opening in the container, a desiccant holder that is carried by the cup, a mesh screen that is dimensioned to hold a desiccant pad so that moisture-laded air can reach it, and a top. The moisture management system performs three functions: (1) it prevents moisture from penetrating into the interior of the container through the opening; (2) it directs moisture-laden air from within the interior of the container to the desiccant so that the moisture can be later removed by removing the desiccant; and (3) it holds the desiccant.

The container also includes pockets and slots for various articles that may be used in conjunction with the contents of the container, such as bleach, softener, coins, wash treatments or debit cards when the container is used to store laundry detergent.

A major advantage of the present invention is the reduction of humidity within the container. As a result, the likelihood of moisture absorption by the detergent is minimized when stored within the container, particularly when the container is equipped with a desiccant. This advantage is derived from the moisture management system, a system that prevents moisture from entering the container when the lid is closed and allows the moisture that has entered when the lid was opened to be absorbed by a desiccant.

A major feature of the present invention is the moisture cup, which performs the three functions indicated.

In an embodiment suitable for use with laundry detergent, the present container provides compartments for all of the supplies, including coins and debit cards, needed to do the laundry, and has a carrying strap, an important group of features of this particular embodiment.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
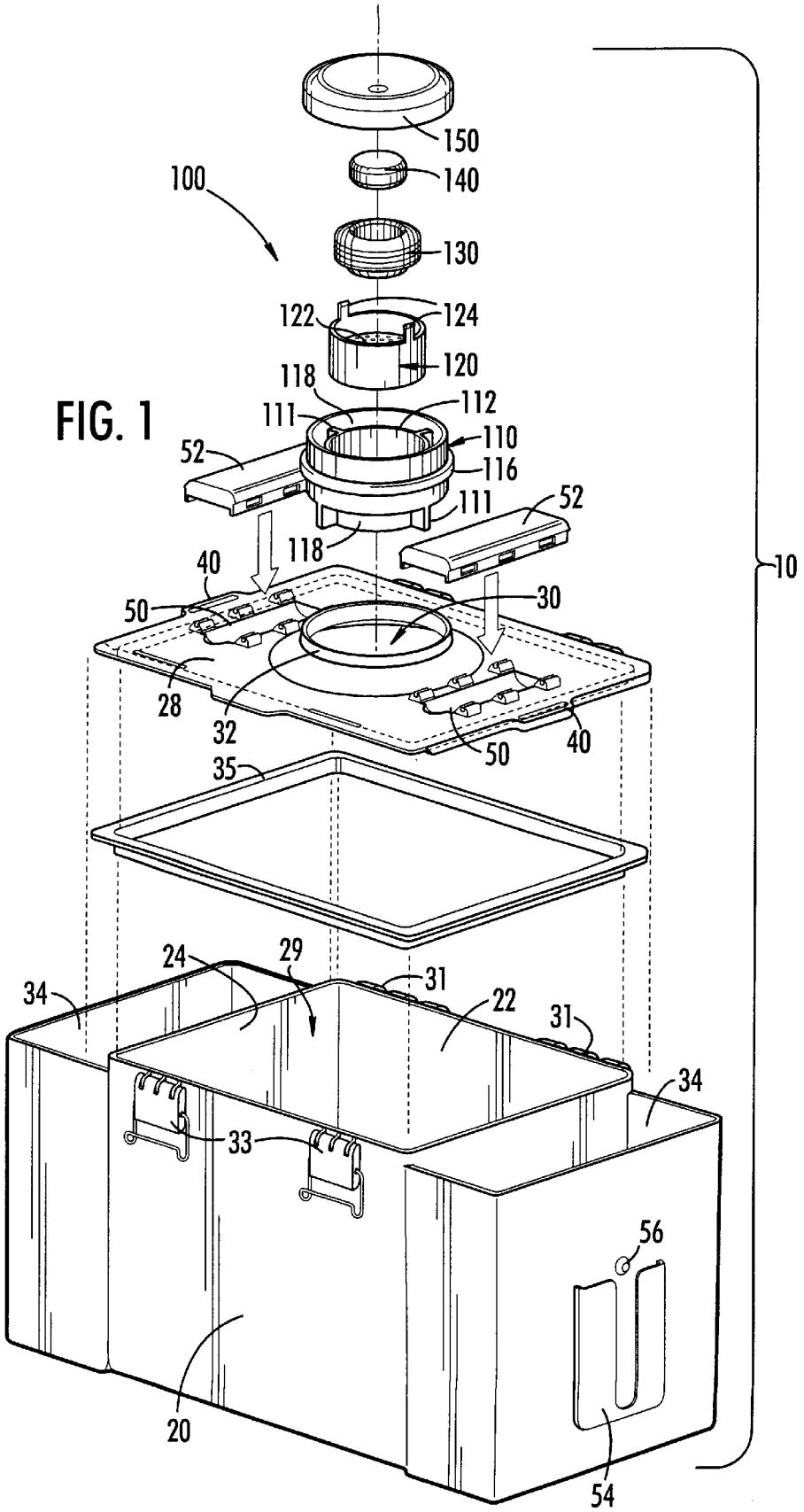
FIG. 1 is an exploded perspective view of the container, according to a preferred embodiment of the present invention.
Figure 2:
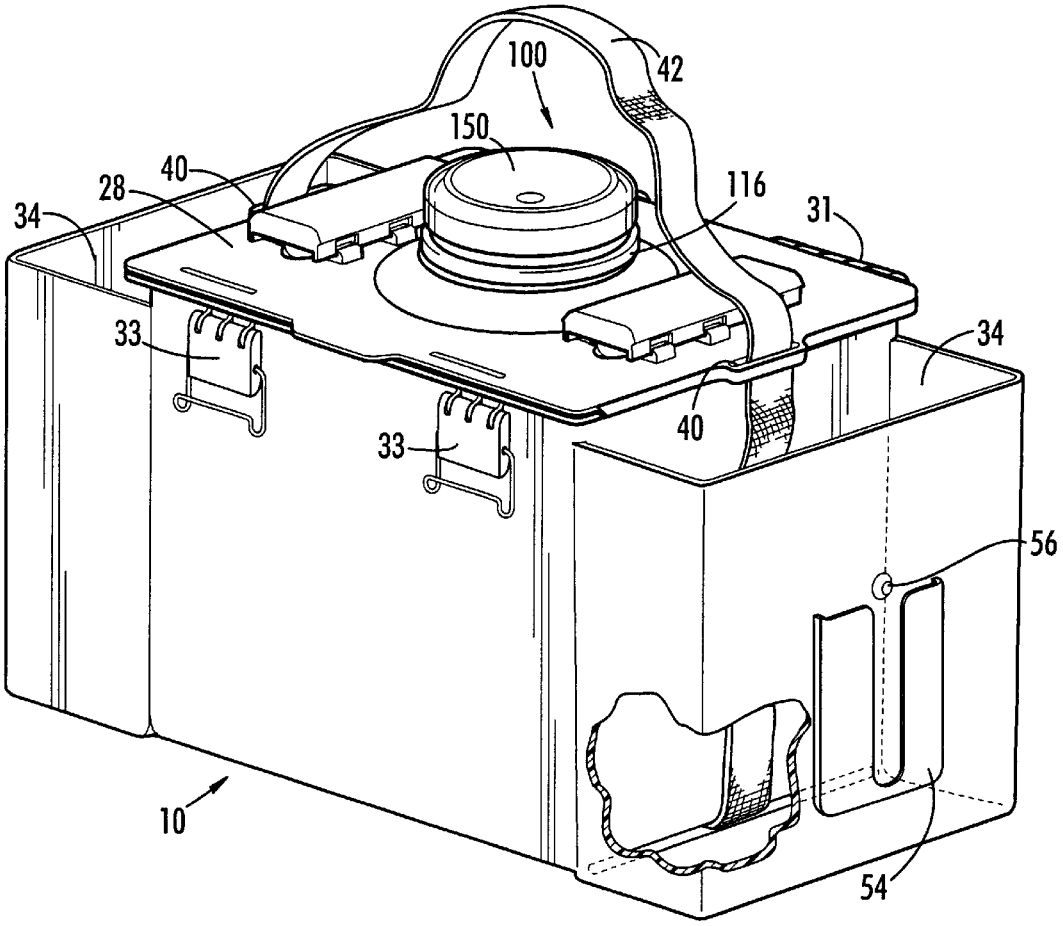
FIG. 2 is a perspective view of the container, according to a preferred embodiment of the present invention.
Figure 3:
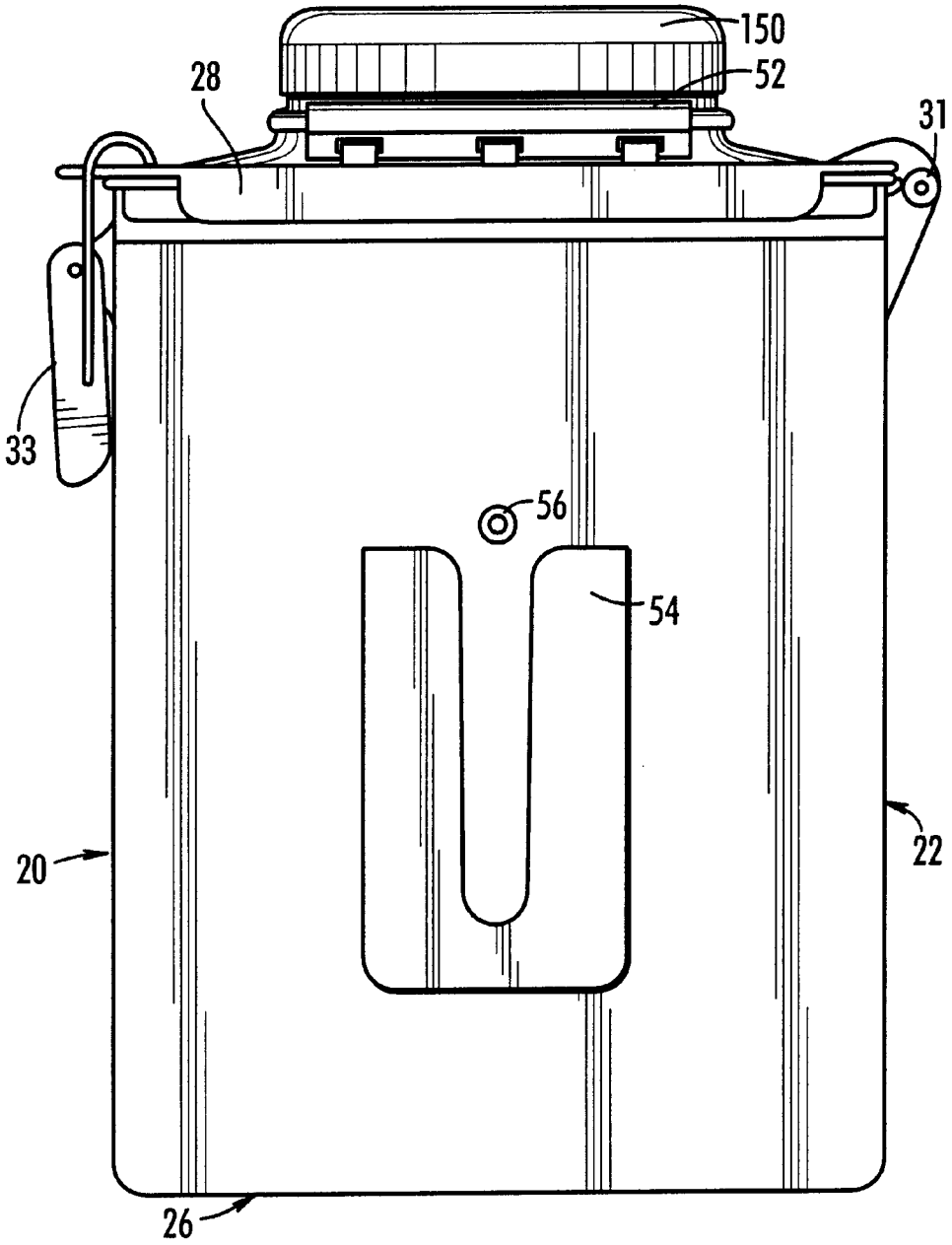
FIG. 3 is a side view of the container, according to a preferred embodiment of the present invention.
Figure 4:
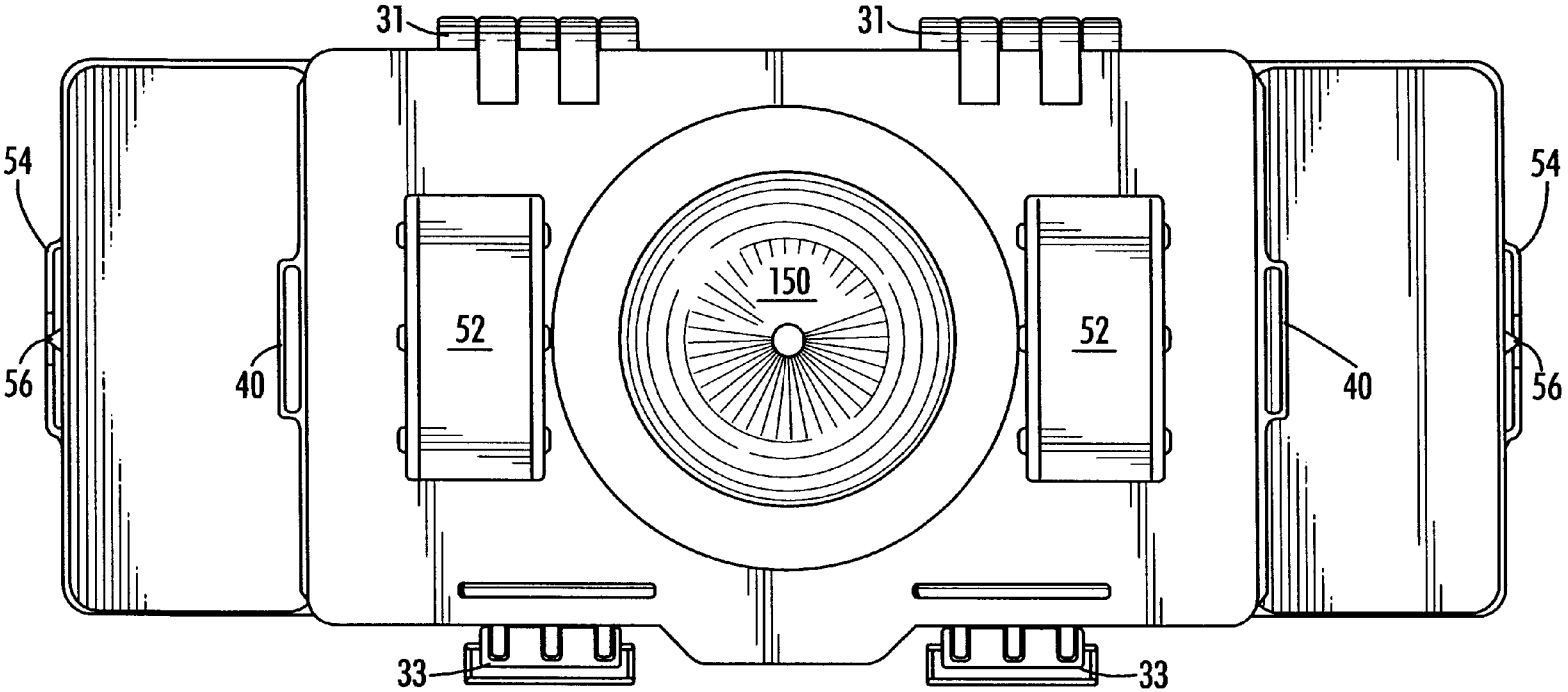
FIG. 4 is a top view of the container, according to a preferred embodiment of the present invention.

Referring now to the figures, the present invention is a container for holding granular material, preferably powdered laundry detergent. The container, generally referred to by reference number 10, has a system that reduces humidity within the interior of the container, so that the granularity of the detergent contained therein (not shown) is maintained. Although the present invention is discussed with reference to powered detergent, it will be appreciated that the container could house various articles, which would benefit from an environment with controlled, limited humidity. For example, the present container could be used to hold a wide variety of foodstuffs such as cereals, dried beans, crackers, dried fruits, dog biscuits, cooking spices, flour, rice, sugar, salt and coffee. The present container could also be used to hold granular chemical fertilizers.

Container 10 has a front wall 20, a back wall 22, a side wall 24, a bottom wall 26 and a lid 28, which altogether define an interior 29. Although container 10 is preferably shaped in the form of a box, container 10 could take any shape. Container 10 could be formed from various materials, but is preferably made with a transparent or translucent plastic material. With either transparent or translucent walls, a user could easily appraise the quantity of detergent remaining within container 10. Exterior to container 10 may optionally contain a plurality of compartments 34 for holding articles other than detergent that are useful in laundering, such as softener, bleach and other pre-wash treatments.

Lid 28 is used to close container 10 tightly when access to interior 29 is not needed, and preferably designed to stay with container 10 even when removed. For example, lid 28 is shown attached to back wall 22 using hinges 31 and secured to front wall 20 using latch 33. Optionally, a rim 35 may surround the periphery of interior 29 in order to further contribute to a tight seal.

Lid 28 has an opening 30 therethrough of sufficient dimension to accommodate moisture management system 100. Opening 30 has a gasket 32 along the periphery so that moisture management system 100 can be secured to container 10 in a substantially air-tight manner. Gasket 32 could be formed from various resilient materials which would allow a substantially air-tight seal between moisture management system 100 and container 10, but is preferably formed from a natural or synthetic rubber material; however, lid 28 can be formed of a material that will both maintain the lid's 28 shape and provide the desired seal between lid 28 and cup 110.

Lid 28 has at least one coin holder 50 on its surface and preferably two of them. Coin holder 50 is dimensioned to accommodate quarters and receives a detachable cover 52. For security purposes, cover 52 is preferably formed from an opaque material.

In order to conveniently hold a debit card or ATM card, container 10 also has an ATM card slot 54 preferably on its sides 24 with sufficient dimension to accommodate such a card. A raised indentation 56 keeps the ATM card in slot 54. Depressing the side of the container immediately above raised indentation 56 allows enough space for the card to pulled free of slot 54. If optional compartments 34 extend from sides 24, preferably ATM slot 54 would be positioned on the side of compartments 34, as shown.

Another type of slot, a strap slot 40, is preferably integrally formed in lid 28 on each side, which is of sufficient dimension to receive strap 42, so that container 10 could be conveniently transported.

Moisture management system 100 is secured to lid 28 in a substantially airtight manner and comprises a cup 110, a desiccant holder 120, a mesh screen 130, a desiccant pad 140 and a top 150. Cup 1 10 has an outer wall 111 of sufficient dimension to engage opening 30 in lid 28 and an inner wall 112 concentric to outer wall 111. Cup 110 has a plurality of passages 118 formed between outer wall 111 and inner wall 112 to allow humidity to pass therethrough. A flange 116 runs along the exterior of outer wall 111 in order to engage opening 30 to seal moisture management system 100 to lid 28. Desiccant holder 120 is dimensioned to fit within inner wall 112 of cup 110. Desiccant holder 120 has pull tabs 124 integrally formed thereon to allow easy removal from cup 110 and holes 116 in the bottom through which extracted moisture from interior 29 of container 10 may pass. Mesh screen 130 is dimensioned to be received within desiccant holder 120. Preferably, mesh screen 130 is concave in shape and dimensioned so that a desiccant pad 140 can be held on mesh screen 130 using a frictional fit. Desiccant pad 140 is preferably an air-permeable pouch containing calcium carbonate.

Figure 5:
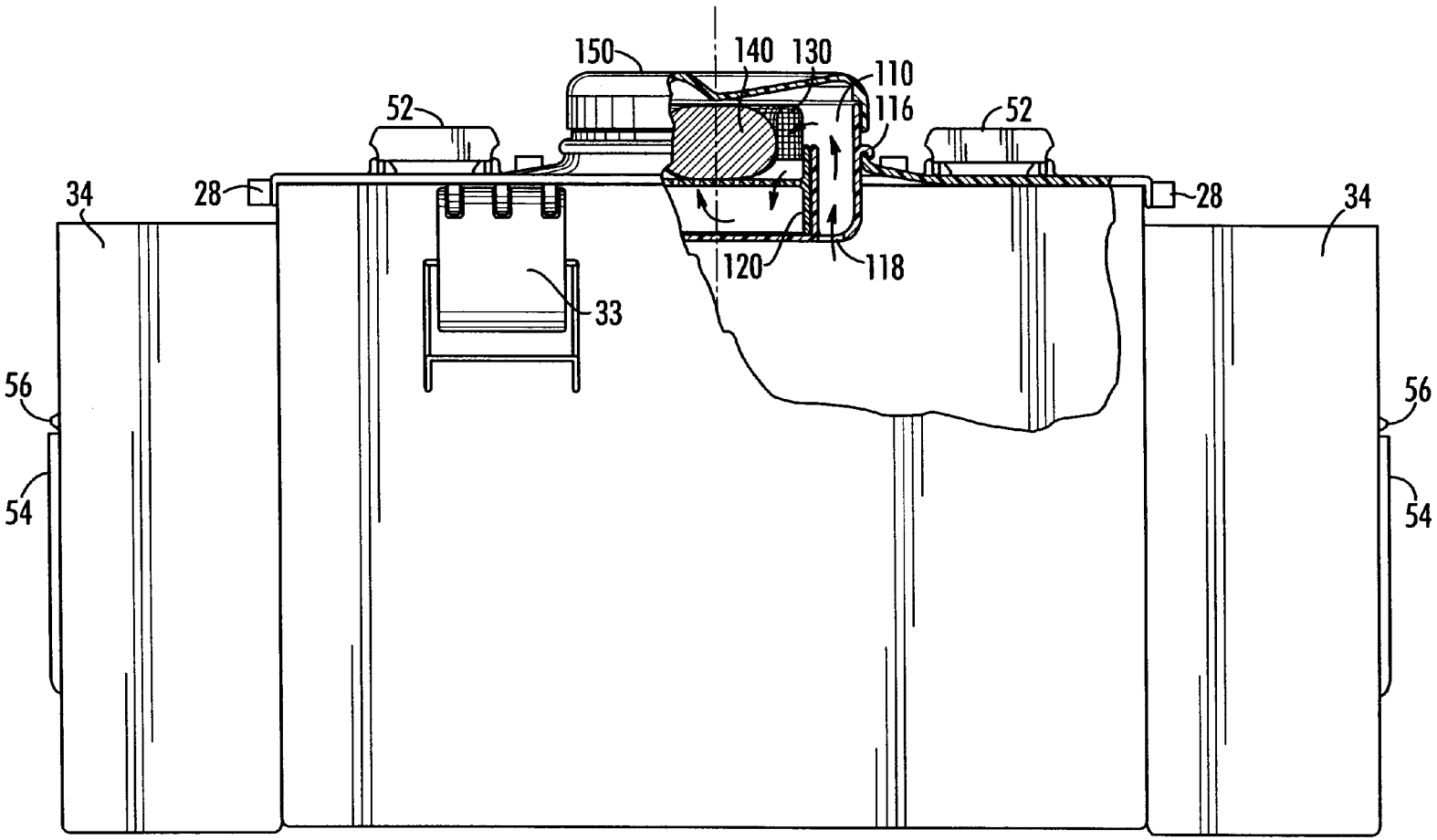
FIG. 5 is a partial cross-sectional front view of the container, according to a preferred embodiment of the present invention.

In use, container 10 is filled with powered laundry detergent. Humidity within container 10 can pass upwardly through passages 118, then through mesh screen 130 to be absorbed by desiccant pad 140, as best seen in FIG. 5. Extracted moisture drips from desiccant pad 140 through the holes in desiccant holder 120 and collects within the interior section of cup 110. Moisture management system 100 is removed as a unit, the desiccant 140 and holder 120 are next removed and any extracted liquid found within cup 110 is discarded.

It will be apparent to those skilled in the art that many changes and substitutions can be made to the preferred embodiment herein described without departing from the spirit and scope if the present invention.

What is claimed is:

1. An article, comprising:

a container having an interior;

a desiccant; and moisture control means carried by said container for preventing moisture from penetrating into said interior of said container, for directing moisture-laden air from within said interior of said container to said desiccant, and for holding said desiccant, wherein said moisture control means includes a cup having an outer wall and concentric inner wall wherein said inner wall is dimensioned to receive said desiccant therein, said cup forming plural passages between said outer wall and said inner wall so that moisture-laden air from said interior of said container is in fluid communication with said desiccant.

2. The article as recited in claim 1, wherein said moisture control means includes a mesh screen for holding said desiccant so that moisture-laden air can reach said desiccant.

3. The article as recited in claim 1, wherein said container has an opening and wherein said moisture control means includes a gasket, said gasket sealing said cup to said container.

4. The article as recited in claim 1, wherein said container includes a lid, said moisture control means carried by said lid.

5. The article as recited in claim 1, further comprising a strap attached to said container.

6. The article as recited in claim 1, wherein said container is made of a material that is translucent.

7. The article as recited in claim 2, wherein said container includes a lid, said moisture control means carried by said lid.

8. The article as recited in claim 2, further comprising a strap attached to said container.

9. The article as recited in claim 2, wherein said container is made of a material that is translucent.

10. The article as recited in claim 2, further comprising means for holding objected selected from the group consisting of coins, ATM cards and debit cards.

11. An article for holding articles, comprising:

a container having an interior;

a desiccant; and moisture control means carried by said container for directing moisture-laden air from within said interior of said container to said desiccant and for holding said desiccant, wherein said moisture control means includes a cup having an outer wall and concentric inner wall wherein said inner wall is capable of holding a desiccant, said cup having a plurality of passages formed between said outer wall and said inner wall so that said interior of said container is in fluid communication with a desiccant carried within said inner wall.

12. The article as recited in claim 11, wherein said moisture control means includes a mesh screen for holding said desiccant.

13. The article as recited in claim 11, further comprising means for holding objected selected from the group consisting of coins, ATM cards and debit cards.

14. The article as recited in claim 11, wherein said container has an opening and wherein said cup is capable of being received by said opening, and wherein said container further comprises means for sealing said cup to said opening.

15. The article as recited in claim 11, wherein said container has a lid hingedly attached thereto, said moisture control means carried by said lid.

16. The article as recited in claim 11, further comprising a strap attached to said container.

17. The article as recited in claim 11, wherein said container is formed from a translucent material.

18. An article, comprising:

a container having a front wall, an opposing rear wall, and a pair of opposing side walls, a bottom wall, a lid and an interior;

a desiccant; and a cup carried by said container having an outer wall and concentric inner wall, wherein said inner wall holds said desiccant and said cup has a plurality of passages formed between said outer wall and said inner wall so that said interior of said container is in fluid communication with said desiccant.

19. The article as recited in claim 18, wherein said container has an opening and wherein said cup is capable of being received by said opening, said container further comprising a gasket for sealing between said cup and said opening.

20. The article as recited in claim 18, further comprising means for holding coins, said holding means being carried by said container.

* * * * *